United States Patent [19]

Barton

[11] 4,388,939

[45] Jun. 21, 1983

[54] LAND-USE PORTABLE KNOCK-DOWN HUNTING-BLIND FRAME

[76] Inventor: Roy C. Barton, Rte. #1, Waltonville, Ill. 62894

[21] Appl. No.: 272,535

[22] Filed: Jun. 11, 1981

[51] Int. Cl.[3] ..... A45F 1/16

[52] U.S. Cl. ..... 135/3 R

[58] Field of Search ..... 135/3 R, 1 R, 4 R, 3 E; 52/633, 109, 63

[56] References Cited

U.S. PATENT DOCUMENTS

| | | | |
|---|---|---|---|
| 1,777,028 | 9/1930 | Berbeck | 135/3 R |
| 2,827,138 | 3/1958 | Roy, Jr. | 135/3 R |
| 4,091,584 | 5/1978 | Brown | 135/1 R |
| 4,257,132 | 3/1981 | Kerby | 135/3 R |

*Primary Examiner*—Richard C. Pinkham
*Assistant Examiner*—T. Brown
*Attorney, Agent, or Firm*—Ralph F. Staubly

[57] ABSTRACT

An on-land-type portable knock-down duck-blind comprises a frame formed of a plurality of arch-shaped metal or plastic tubes adapted to support a removable water-proof fabric cover. The tubes are held in parallelism by short spacing tubes, and are interconnected and are braced by a transverse inverted-U-shaped member having spaced U-shaped bends therein to receive sleeves which detachably connect the ends of each arch-shaped tube where medially divided for portable compactness. A pair of two-panel doors are mounted on rectangular frames which are detachably mounted on the central pair of parallel tubes by depending pins received in holes in the tubes.

7 Claims, 5 Drawing Figures

FIG. 1
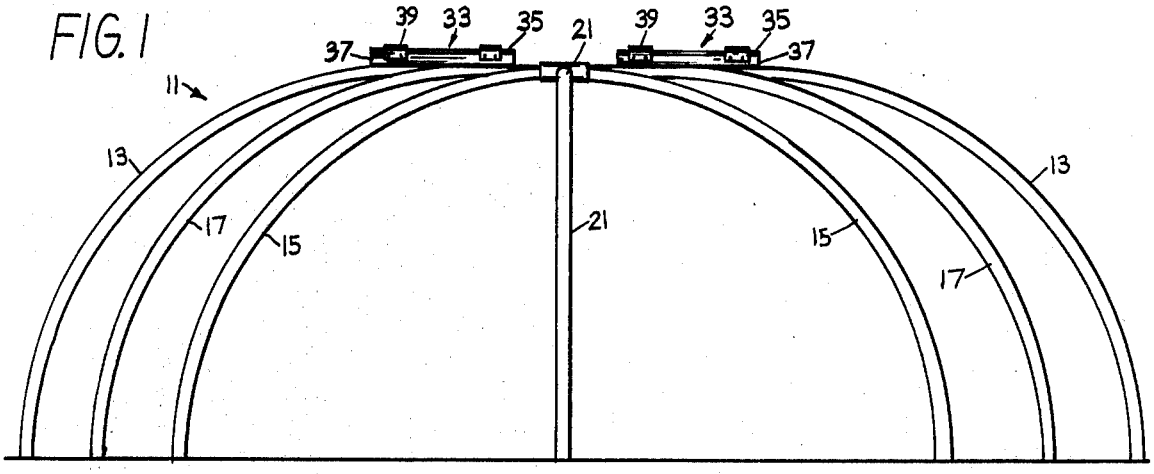
FIG. 2
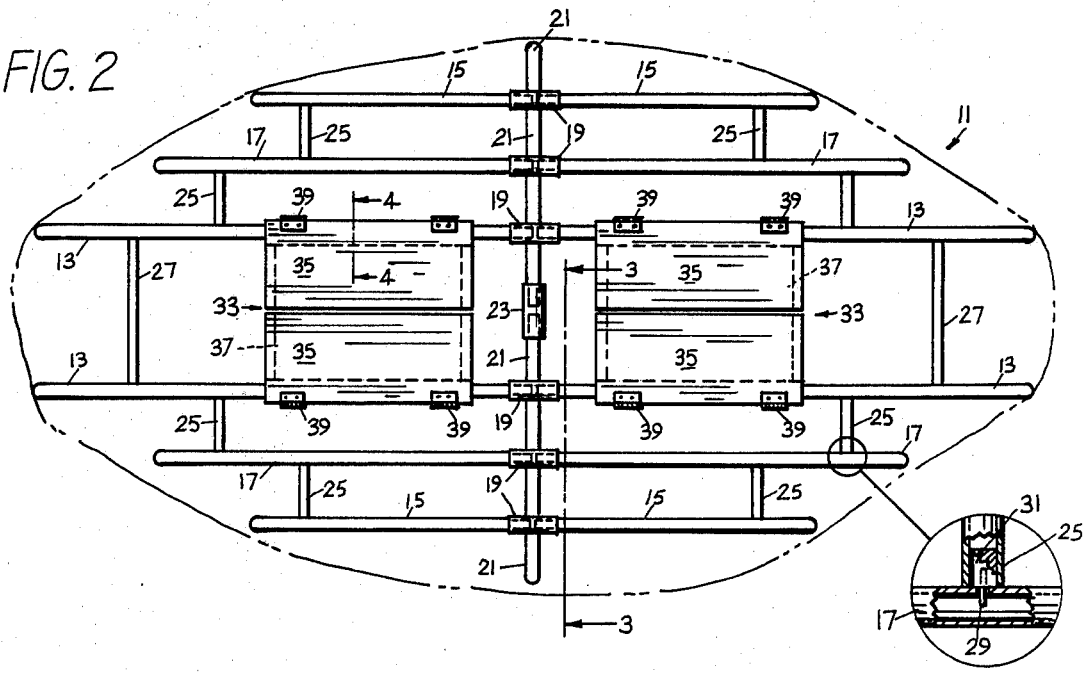
FIG. 3
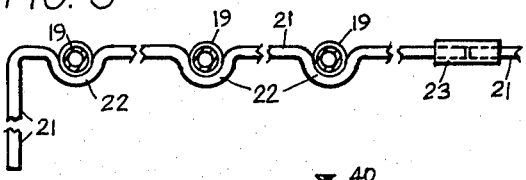
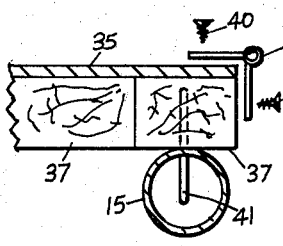
FIG. 4
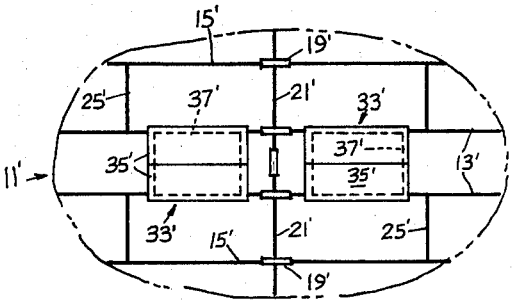
FIG. 5

LAND-USE PORTABLE KNOCK-DOWN HUNTING-BLIND FRAME

BACKGROUND AND OBJECTS OF THE INVENTION

Portable collapsible hunting blinds are known, for example, U.S. Pat. No. 3,018,857 to Parham. But there is not known a hunting-blind having a fabric-covered knock-down frame formed primarily of a plurality of parallel medially divided arch-shaped light-weight pipe sections. It is the principal object of this invention to provide such a hunting-blind frame.

BRIEF DESCRIPTION OF THE DRAWING FIGURES

FIG. 1 is a side elevational view of the assembled frame.

FIG. 2 is a plan view of the disclosure of FIG. 1.

FIG. 3 is an enlarged fragmentary elevational view in section taken on the line 3—3 of FIG. 2.

FIG. 4 is an enlarged fragmentary elevational view taken on the line 4—4 of FIG. 2.

FIG. 5 is a schematic plan view of a fewer-parts species of the invention.

DETAILED DESCRIPTION

With reference now to FIGS. 1–4 of the drawing, the numeral 11 generally designates an assembled two-hunter frame embodying the invention. The frame 11 is basically formed of four long arcuate pipe sections 13, four short pipe sections 15, and four intermediate-length pipe sections 17, all being, for example, two-inch-diameter polyvinyl-chloride or aluminum-alloy pipes. Looking in FIG. 2 at the pipe sections on the left side of central pipe sections 21, there are a pair of pipes 15 of the same length (the topmost and lowermost pipes in FIG. 2), a pair of pipe sections 17, and a pair of pipe sections 13. The arcuate pipe sections 13–17 are connected by press-fitted sleeves 19 to form arch-shaped ribs to support a plastic or canvas water-repellant tent-like canopy (not shown) which can be lifted at its ends to permit entrance between the longer pipe sections.

The arch-shaped ribs are laterally interconnected and are supported by a pair of gamma-shaped pipe sections 21 having spaced U-shaped bends 22 in their horizontal reaches, which reaches are axially connected by a press-fitted sleeve 23. The U-shaped bends 22 of the pipe sections 21 form cradles which snugly embrace the sleeves 19. The pipe sections 13–17 are further braced and held in parallelism by eight short pipe sections 25 and two longer pipe sections 27, which may be held assembled as shown in the enlargement circle of FIG. 2.

In said enlargement circle, the short pipe section 25 has a pin 29 fixed thereto by being embedded in a plug 31 and extending axially from the pipe section 25 to enter an aperture preformed in the rib-forming arcuate pipe section 17.

Two trap-doors 33 are formed of paired panels 35 attached to rectangular frames 37 by hinges 39 and screws 40. In FIG. 4, the frame 37 is shown liftably detachably positioned on the long pipe section 15 by a pin 41 embedded in the frame 37 and extending downwardly into a pre-formed aperture in the pipe section 15.

FIG. 5 is a schematic showing of a modified frame employing fewer pipe sections, but basically embodying the same inventive concepts as FIGS. 1–4. Primed reference numerals in FIG. 5 indicate parts corresponding to like parts in FIGS. 1–4.

The invention having been described, what is claimed is:

1. A knock-down portable frame for supporting a water-proof cover to form a hunter-concealing blind, comprising: a plurality of pairs of arcuate-ninty-degree bent pipes, each pair having pipes of the same length but having a length different from the length of pipes of the remaining pairs of pipes of said plurality, each said pair of pipes being releasably joined endwise to an vertical pipe by telescoping elements to define a generally semi-elipsoidal space when over-ground-supported in an assembled parallelism; a pair of L-shaped pipes releasably endwise-joinable to form a flat-topped arch for transversely supporting said endwise joined ends of said pairs of arcuate pipes; and short rigid elements transversely and horizontally spacedly fixed to the top of said flat-topped arch for telescopically connecting said endwise joined ends of said pairs of arcuate pipes to each other and to said top of said flat-topped arch.

2. A frame according to claim 1 wherein said telescoping elements are sleeves.

3. A frame according to claim 1 wherein said pipes are formed of polyvinyl chloride.

4. A frame according to claim 1 and additionally comprising a plurality of short rods spacingly connected between adjacent arcuate pipes.

5. A frame according to claim 1 and additionally comprising at least one easily operated door attached to said frame medially thereof.

6. A frame according to claim 5 wherein said door has two oppositely hinged panels normally spring-held in closed horizontal alignment.

7. A frame according to claim 5 wherein said door is mounted in a framing structure.

* * * * *